United States Patent [19]

Takauji

[11] Patent Number: 4,466,325

[45] Date of Patent: Aug. 21, 1984

[54] TONE SYNTHESIZING SYSTEM FOR ELECTRONIC MUSICAL INSTRUMENT

[75] Inventor: Kiyomi Takauji, Hamamatsu, Japan

[73] Assignee: Kabushiki Kaisha Kawai Gakki Seisakusho, Japan

[21] Appl. No.: 372,051

[22] Filed: Apr. 26, 1982

[30] Foreign Application Priority Data

Apr. 30, 1981 [JP] Japan ..... 56-65712

[51] Int. Cl.[3] ..... G10H 1/08; G10H 1/46

[52] U.S. Cl. ..... 84/1.22; 84/1.27

[58] Field of Search ..... 84/1.01, 1.19–1.23, 84/1.27, 345, 370

[56] References Cited

U.S. PATENT DOCUMENTS

| | | | |
|---|---|---|---|
| 3,908,504 | 9/1975 | Deutsch | 84/1.19 |
| 3,913,442 | 10/1975 | Deutsch | 84/1.19 |
| 4,085,644 | 4/1978 | Deutsch et al. | 84/1.01 |
| 4,273,018 | 6/1981 | Deutsch | 84/1.22 |
| 4,300,432 | 11/1981 | Deutsch | 84/1.01 |
| 4,331,058 | 5/1982 | Deutsch | 84/1.21 |

FOREIGN PATENT DOCUMENTS 120818 10/1977 Japan .

*Primary Examiner*—S. J. Witkowski

*Attorney, Agent, or Firm*—McGlew and Tuttle

[57] ABSTRACT

A tone synthesizing system which prevents the dynamic range from becoming unduly wide with an increase in the number of tone tablet switches being selected concurrently in an electronic musical instrument of the type synthesizing a musical sound through the use of a discrete Fourier transfer. In the electronic musical instrument in which, for obtaining a desired musical waveshape, amplitude values at its sample points are computed through the synthesizing system using the discrete Fourier transfer, harmonic coefficients of the tones selected or sine-wave values in accordance with the number of tone tablet switches being simultaneously selected are attenuated at a desired rate to limit a maximum level of an accumulated value of the harmonic coefficients or sine-wave values as predetermined.

3 Claims, 16 Drawing Figures

TONE SYNTHESIZING SYSTEM FOR ELECTRONIC MUSICAL INSTRUMENT

BACKGROUND OF THE INVENTION

1. Field of the Invention

The present invention relates to a tone synthesizing system which prevents their dynamic range from becoming excessively wide with an increase in the number of tablet select switches being simultaneously selected in a digital electronic musical instrument of the type synthesizing a waveshape through a discrete Fourier transfer.

2. Description of the Prior Art

To obtain a desired musical waveshape, there has heretofore been used an electronic musical instrument of the type that the amplitude values at sample points of the waveshape are computed through utilization of a waveshape synthesizing system employing a discrete Fourier transfer as disclosed, for instance, in U.S. Pat. No. 4,085,644. In the tone tablet selection of such an electronic musical instrument, a linear addition of tones calls for a wide dynamic range and an increase in the number of bits used introduces complexity in the circuit structure and naturally raises the manufacturing costs. And another problem is a feeling of incongruity which is produced when the volume rapidly increases with an increase in the number of tones as a result of such a linear addition. In contrast thereto, in order to prevent that musical signals are added as they are, there have been proposed a method in which tone tablet switches are used as a plurality of contacts and one of them is employed to vary the entire signal level as in a conventional analog organ, for instance, and a method of directly controlling an output signal in accordance with the number of tone tablet switches used as disclosed, for example, in Japanese Patent Application No. 37519/1976 (Pat. Laid-Open No. 120,818/1977). These methods control an analog output signal, and hence they possess defects in accuracy and mixture of noise.

SUMMARY OF THE INVENTION

It is an object of the present invention to provide a tone synthesizing system which prevents the dynamic range becomes excessively wide with an increase in the number of tone select tablet switches being simultaneously selected in digital electronic musical instruments of a synthesizing system using a discrete Fourier transfer.

To attain the abovesaid object, the tone synthesizing system of the present invention for electronic musical instruments in which, for obtaining a desired musical waveshape, amplitude values of its sample points are computed by a synthesizing method using a discrete Fourier transfer, is provided with means for attenuating at a desired rate harmonic coefficients of tones selected or sinusoid values of tones selected in accordance with the number of tone select tablet switches being simultaneously selected, thereby to limit a maximum level of an accumulated value of the harmonic coefficients or sinusoid values as predetermined.

DESCRIPTION OF THE PREFERRED EMBODIMENTS

Figure 1:
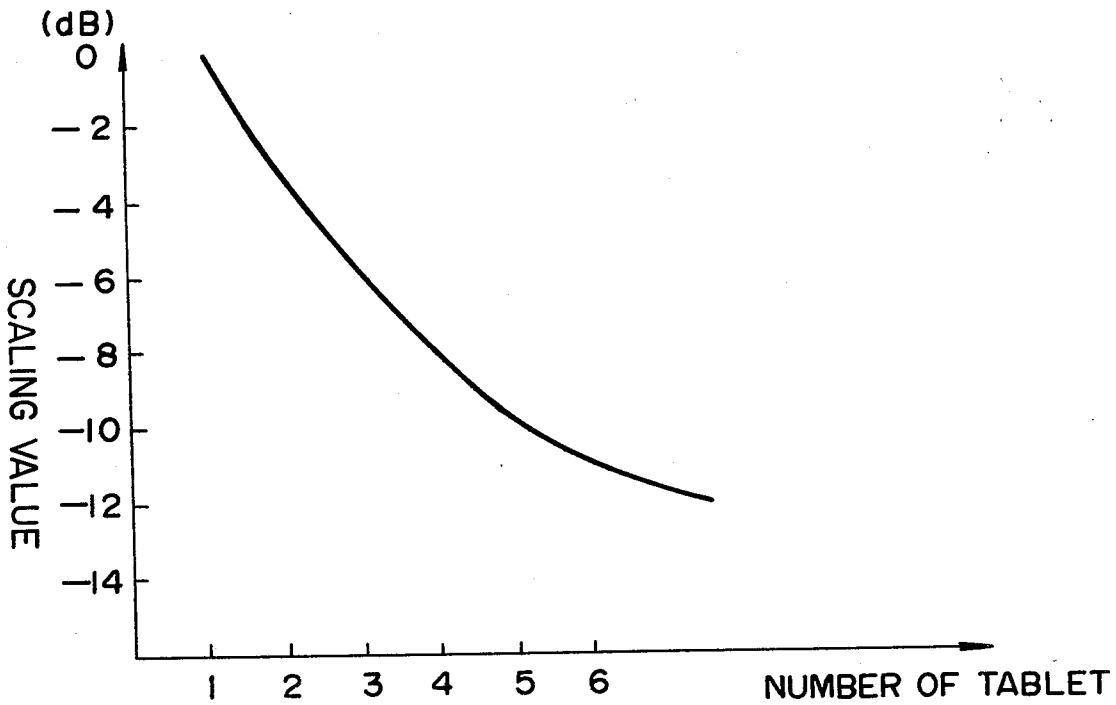
FIG. 1 is a graph explanatory of the principle of the present invention.
Figure 2A:
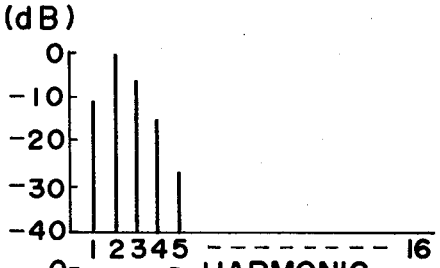
FIGS. 2(*a*) to (*k*) graphs are explanatory of the operation of the present invention.
Figure 2B:
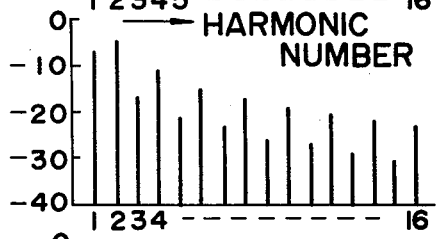
Figure 2C:
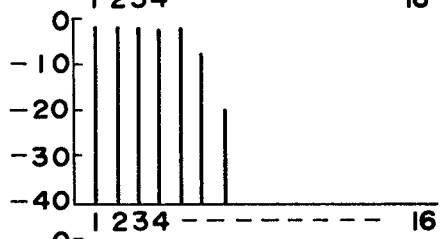
Figure 2D:
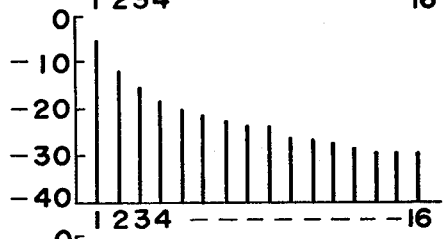
Figure 2E:
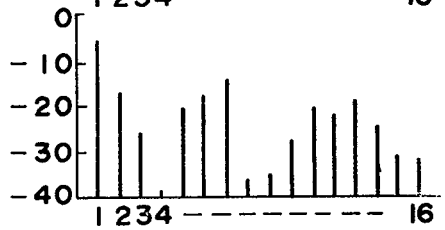
Figure 2F:
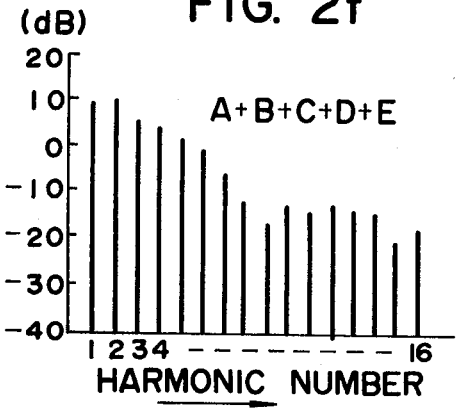
Figure 2G:
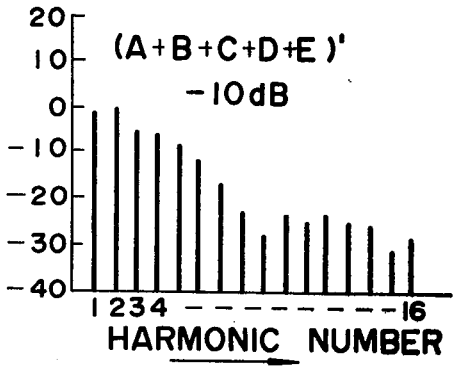
Figure 2H:
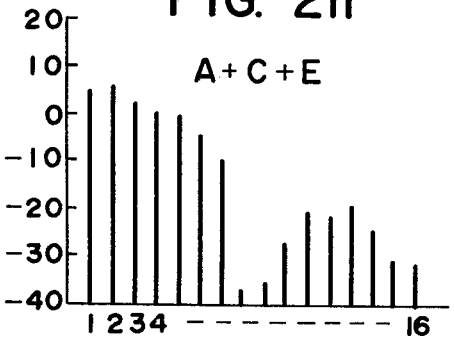
Figure 2I:
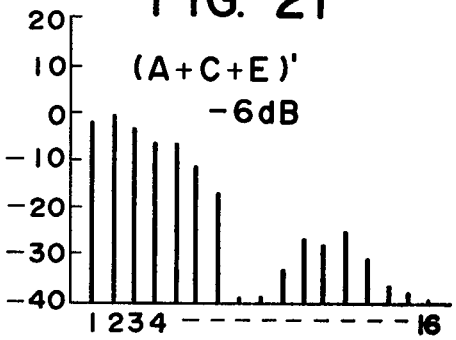
Figure 2J:
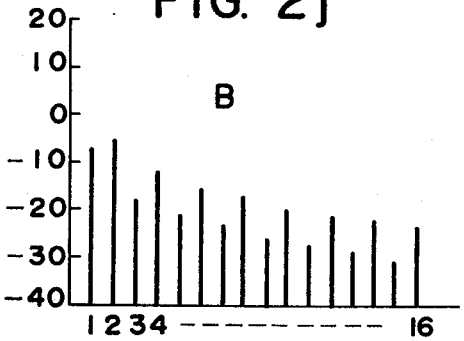
Figure 2K:
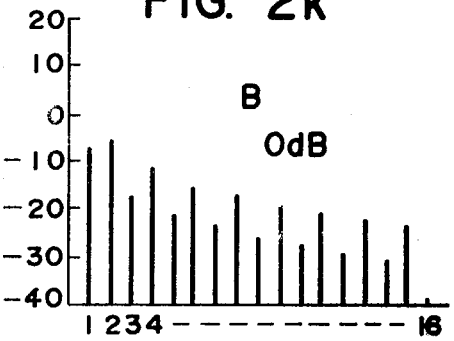

FIG. 1 is explanatory of the principle of the present invention, the abscissa representing the number of tablets for simultaneous selection and the ordinate a scaling value. FIG. 1 shows, by way of example, an attenuation of harmonic coefficients or a sinusoid value when the scaling value is 0 dB with one tone tablet switch selected. The scaling value is read out in accordance with the number of tablets concurrently selected, and harmonic coefficients or a sinusoid value, or an accumulated value of harmonic coefficients of selected tones is multiplied by the scaling value.

FIGS. 2(*a*) to (*k*) show examples of the application of the abovesaid principles. FIGS. 2(*a*) to (*e*) exemplify five tones A to E having harmonic coefficients up to 16 harmonics. FIG. 2(*f*) shows an unattenuated accumulated harmonic coefficient A+B+C+D+E in the case of five tones being selected. FIG. 2(*g*) shows an accumulated harmonic coefficient (A+B+C+D+E)′ in the case of a scaling value −10 dB in FIG. 1 being applied. FIG. 2(*h*) shows an unattenuated harmonic coefficient A+C+E in the case of three tones being selected. FIG. 2(*i*) shows an accumulated harmonic coefficient (A+C+E)′ in the case of a scaling value −6 dB being applied. FIG. 2(*j*) shows the case of only a tone B being selected without attenuation. FIG. 2(*k*) shows the same result as that of FIG. 2(*b*) in the case of the scaling value being 0 dB.

By such a selection of the scaling value in accordance with the number of tone tablet switches selected concurrently, the maximum level of the accumulated value is limited to a predetermined value (0 dB in this case) as depicted in FIGS. 2(*g*), (*i*) and (*k*), ensuring to prevent that the dynamic range becomes excessively wide.

Figure 3A:
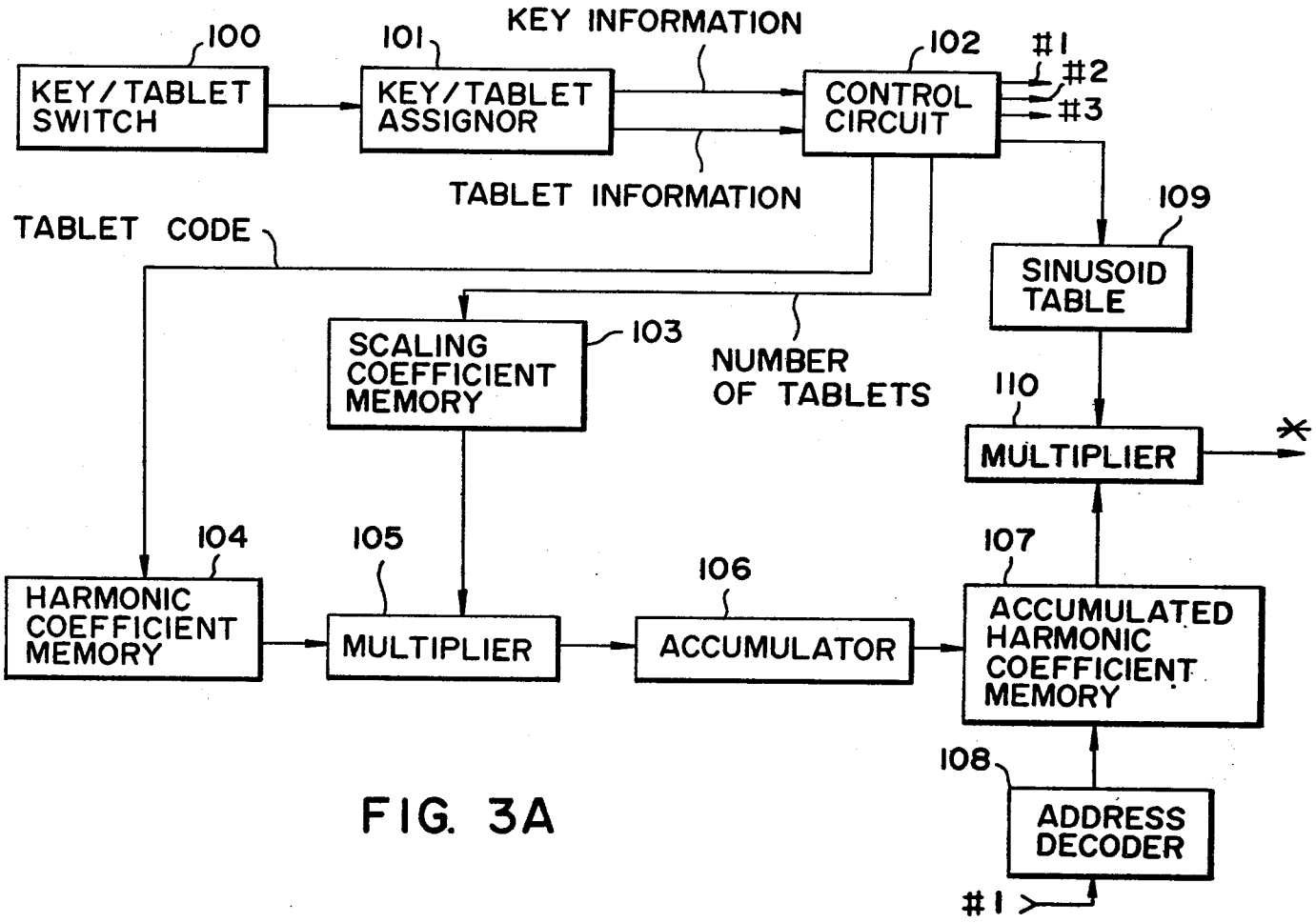
FIGS. 3(A) and (B) illustrate in block form the arrangement of an embodiment of the present invention.

FIGS. 3(A) and (B) illustrate the arrangement of an embodiment of the present invention. In FIGS. 3A and B, upon depression of a key/tablet switches 100, the on-off state of a key/tablet is assigned by a key/tablet assignor 101, and key information and tablet information are sent to a control circuit 102. Form the control circuit 102 are sent out addresses of control signals #1 to #3 to respective parts described later and, at the same time, tablet codes are provided to a harmonic coefficient memory 104 to read out therefrom harmonic coefficients of tones being selected, which are applied to a multiplier 105. Furthermore, the number of tablets selected simultaneously is provided to a scaling coefficient memory 103, which is a principal part of the present invention, and the scaling value in FIG. 1, for instance, is fed to the multiplier 105, wherein each harmonic coefficient is multiplied by the scaling value. The harmonic coefficients, each thus attenuated, are provided to an accumulator 106, wherein the harmonic coefficients of each tone are accumulated for each of the fundamental wave, second, . . . , and 16th harmonics. When three tones A, C and E are selected, if a constant scaling value G is used, then an accumulated harmonic coefficient Hn is given as follows:

$$Hn = \sum_{n=1}^{16} (G \cdot H_{An} + G \cdot H_{Cn} + G \cdot H_{En}) \quad (1)$$

The accumulated harmonic coefficient for each harmonic is stored in an accumulated harmonic coefficient memory 107 from the accumulator 106 but, in this case, the write and readout of the memory 107 are carried out on a time shared basis; therefore, a waveshape is synthesized using harmonic coefficients previously stored while performing the accumulation of the harmonic coefficients. The time-shared write and readout operations are carried out under the control of the control signal #1 which is applied via an address decoder 108 from the control circuit 102. In the abovesaid equation (1) the attenuation is performed using the constant scaling value G but it is often desired to put stress on one or more of the selected tones as is the case with actual playing of a musical instrument. In such a case, scaling coefficients $G_1$, $G_2$ and $G_3$ are selected for the three tones A, C and E. To this end, the scaling coefficients $G_1$, $G_2$ and $G_3$ for each combination of tones to be selected simultaneously are preset, for instance, in the scaling coefficient memory 103 and the combination is detected and read out therefrom.

The accumulated harmonic coefficient read out from the accumulated harmonic coefficient memory 107 is provided to a multiplier 110, in which it is multiplied by a sine-wave amplitude read out from a sinusoid table 109 by an address from the control circuit 102. The output from the multiplier 110 is applied to an accumulator 111 for accumulation to obtain amplitude values at sample points of a waveshape. Next, the amplitude values at the sample points of the waveshape are loaded in a main memory 112. This write and the readout of the amplitude value at the sample points synthesized previously are carried out on a time shared basis. The time shared write and readout are placed under the control of the control signal #2 from the control circuit 102. The waveshape amplitude value data read out from the main memory 112 are written via an address selector 115 in a note memory 114 on a time shared basis using the control signal #3 from the control circuit 102 and are read out via the address selector 115 on a time shared basis by a readout address from a note address generator 116 which generates an address corresponding to a scale frequency. The waveshape amplitude data thus read out from the note memory 114 are provided to a multiplier 118, in which they are multiplied by envelope values from an envelope generator 117, such as attack, decay and sustain. The waveshape amplitude data from the multiplier 118 are converted by a D/A converter 119 to analog form for input to a sound system 120.

Figure 4:
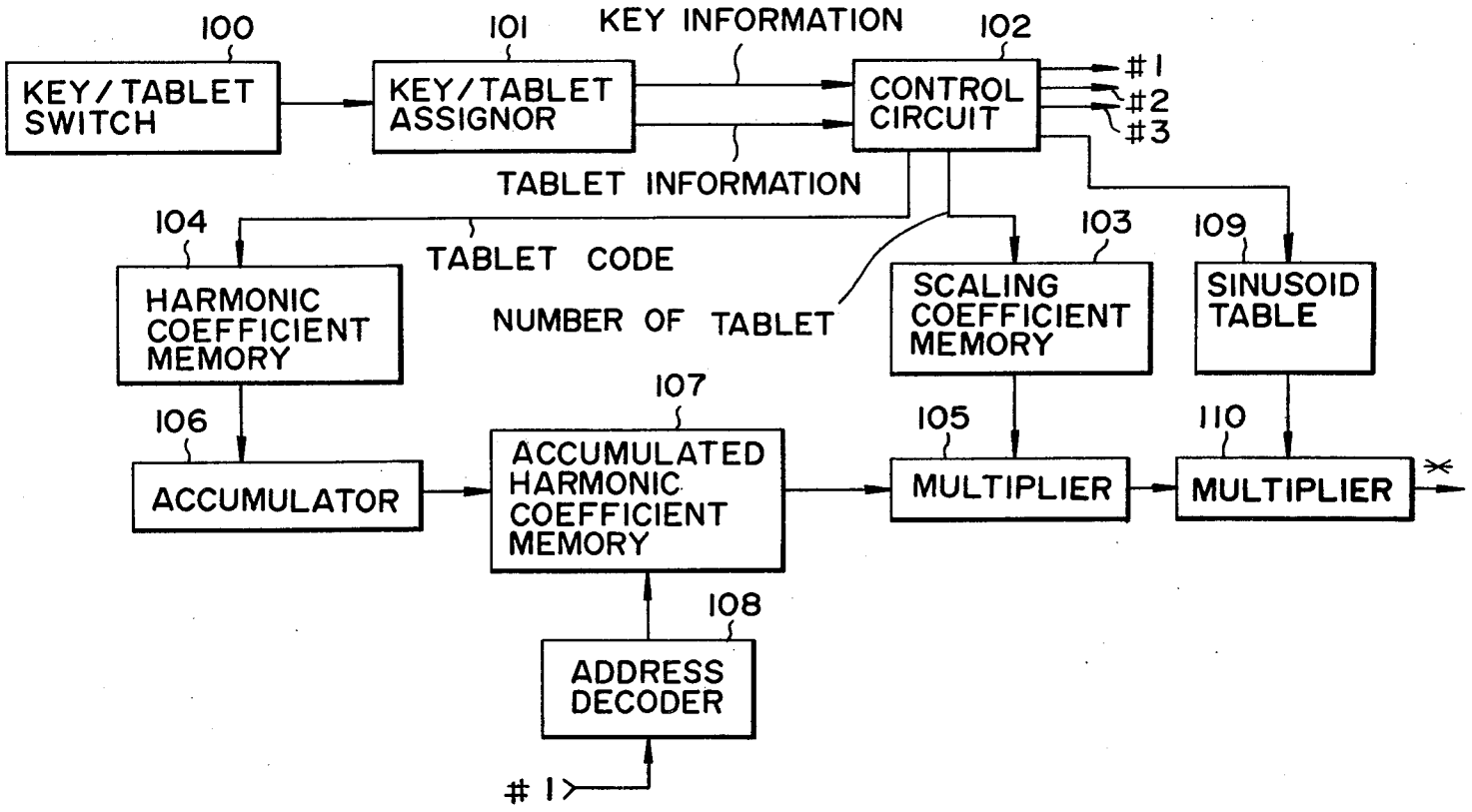
FIGS. 4 and 5 are block diagrams illustrating the arrangements of other embodiments of the present invention.

FIG. 4 is a block diagram illustrating the arrangement of another embodiment of the present invention, which corresponds to FIG. 3A.

Figure 3B:
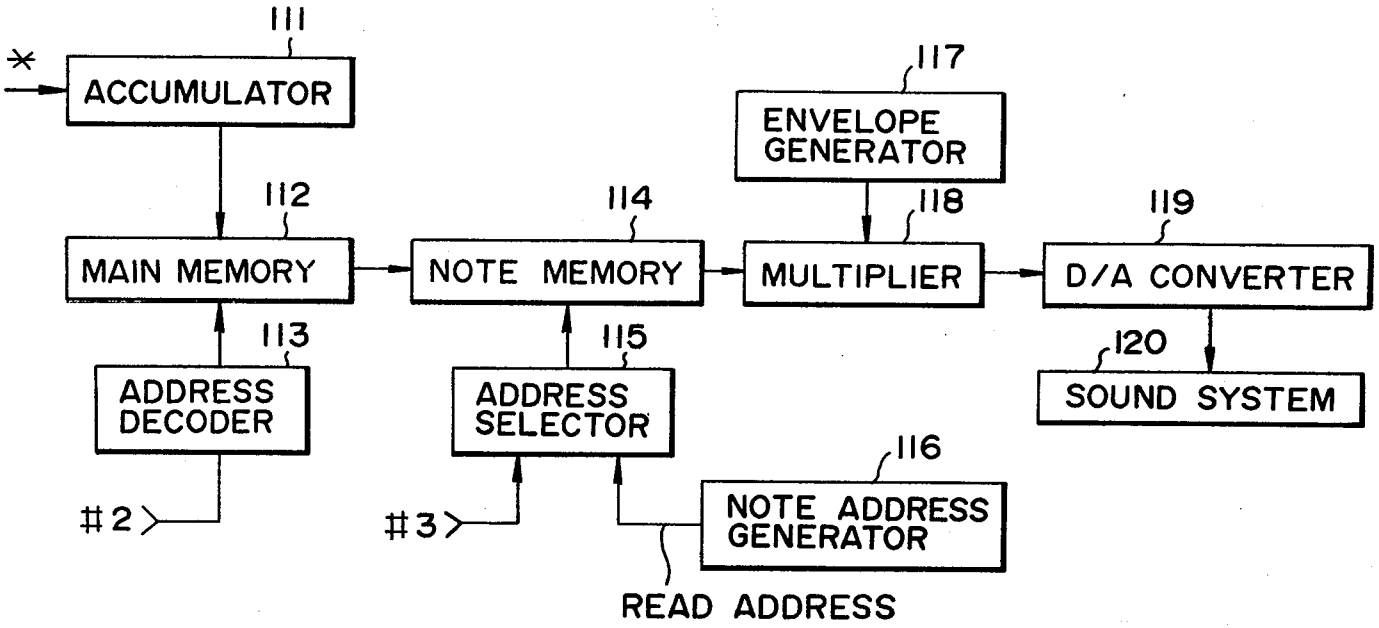

In the embodiment of FIGS. 3A and B the harmonic coefficients of the selected tones are multiplied by the scaling value before they are accumulated, whereas in the embodiment of FIG. 4 the accumulated harmonic coefficients are multiplied by the scaling value. Accordingly, the multiplier 105 is connected between the accumulated harmonic coefficient memory 107 and the multiplier 110, and the output from the scaling coefficient memory 103 is applied to the multiplier 105. The same results obtainable with the embodiment of FIG. 3 are also obtained.

Figure 5:
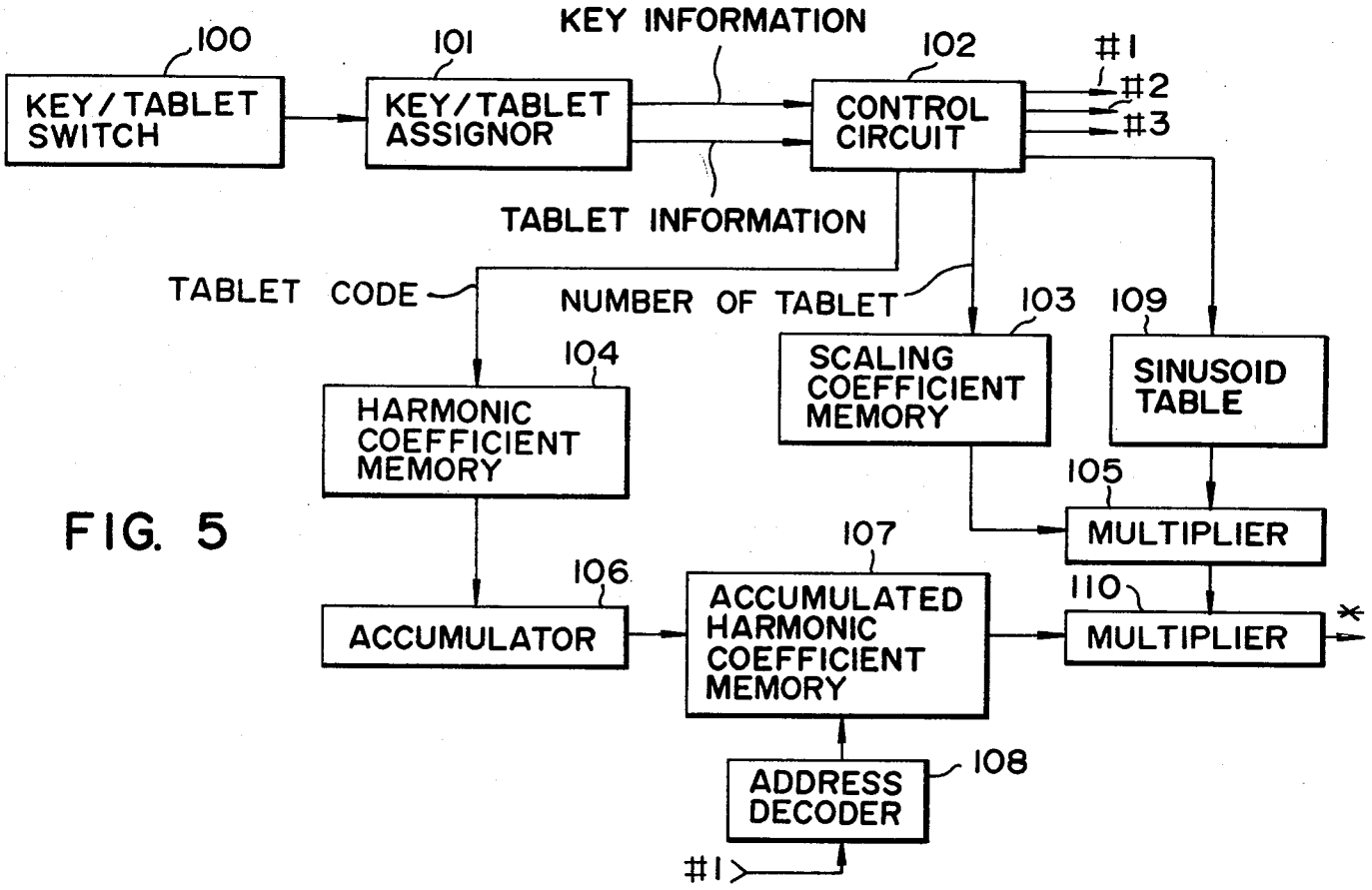

FIG. 5 is a block diagram illustrating the arrangement of another embodiment of the present invention, which similarly corresponds to FIG. 3A.

In this embodiment, the sine-wave value, instead of the harmonic coefficient, is multiplied by the scaling value. Accordingly, the multiplier 105 is connected between the sinusoid table 109 and the multiplier 110, and the output from the scaling coefficient memory 103 is provided to the multiplier 105. From the principle of the synthesization using the discrete Fourier transfer, it is apparent that this embodiment is equivalent to the embodiment of FIG. 3A.

As has been described in the foregoing, according to the present invention, since the harmonic coefficients of the tones selected or sine-wave values in accordance with the number of tone select tablet switches simultaneously selected is attenuated at a desired rate, the dynamic range need not be wide and the circuit structure does not become bulky; therefore, the present invention is advantageous economically as well. Moreover, tone accuracy is high and the problem of noise mixture does not occur. In addition, the present invention solves the feeling of incongruity resulting from a rapid increase in the volume caused by an increase in the number of tones being selected.

It will be apparent that many modifications and variations may be effected without departing from the scope of the novel concepts of the present invention.

What is claimed is:

1. A tone synthesizing system for electronic musical instruments which computes, for obtaining a desired musical waveshape, amplitude value at sample points of the waveshape by a synthesizing system using a discrete Fourier transfer, comprising:

a plurality of tone tablet switch means for selecting a desired tone;

means for detecting the number of those of the tone tablet switch means which are selected simultaneously; and means for scaling one of harmonic coefficient values corresponding to the selected tone tablet switch means and sinusoid values for use in a discrete Fourier transfer at a ratio corresponding to the number of simultaneously selected tone tablet switches detected by the detecting means, thereby limiting a maximum level of an amplitude value of the desired synthesized waveshape to a value corresponding to the ratio.

2. A tone synthesizing system according to claim 1, which further comprises accumulating means for accumulating, for each harmonic order, the harmonic coefficients corresponding to the selected tone tablet switch means to obtain a set of composite harmonic coefficients, and wherein the means for scaling multiplies the harmonic coefficient of a selected tone by the ratio before the accumulation of the harmonic coefficients.

3. A tone synthesizing system according to claim 1, which further comprises accumulating means for accumulating, for each harmonic color, the harmonic coefficients corresponding to the selected tone tablet switch means to obtain a set of composite harmonic coefficients, and wherein the means for scaling multiplies the set of composite harmonic coefficients by the ratio.

* * * * *